US011317684B1

(12) United States Patent
Delano

(10) Patent No.: US 11,317,684 B1
(45) Date of Patent: May 3, 2022

(54) NECKLACE HAVING INTEGRATED PENDANT ANCHOR

(71) Applicant: Misa Design, LLC, Marietta, GA (US)

(72) Inventor: Cigdem Esin Delano, Marietta, GA (US)

( * ) Notice: Subject to any disclaimer, the term of this patent is extended or adjusted under 35 U.S.C. 154(b) by 0 days.

(21) Appl. No.: 16/662,835

(22) Filed: Oct. 24, 2019

Related U.S. Application Data

(60) Provisional application No. 62/854,976, filed on May 31, 2019, provisional application No. 62/750,806, filed on Oct. 25, 2018.

(51) Int. Cl.
*A44C 25/00* (2006.01)
*A44C 15/00* (2006.01)

(52) U.S. Cl.
CPC ..... *A44C 15/0055* (2013.01); *A44C 25/001* (2013.01)

(58) Field of Classification Search
CPC ... A44C 15/005; A44C 15/0055; A44C 11/00; A44C 25/00; A44C 25/001
USPC ..... D11/12, 13, 6, 7, 8, 79, 86, 87; 63/3, 63/3.1, 4, 21, 33, 35, 38
See application file for complete search history.

(56) References Cited

U.S. PATENT DOCUMENTS 1,683,545 A * 9/1928 Raya ..... A44C 15/002 63/1.15
1,853,387 A * 4/1932 Vetter ..... A44C 5/2038 24/600.9
4,270,366 A * 6/1981 Green ..... A44C 17/0258 63/3
D267,789 S * 2/1983 Winandy ..... D11/8
D269,770 S * 7/1983 Pittenger ..... D11/87
5,148,689 A * 9/1992 Azrielant ..... A44C 15/00 63/21
5,279,132 A * 1/1994 Swaim ..... A44C 15/00 63/1.18
D348,023 S * 6/1994 Horner ..... D11/43
5,669,242 A * 9/1997 Cayton ..... A44C 11/002 24/299
6,026,515 A * 2/2000 Nielson ..... A44C 15/00 150/134
6,422,036 B1 * 7/2002 Giannis ..... A44C 5/185 63/3
D467,829 S * 12/2002 Novak ..... D11/79
(Continued)

*Primary Examiner* — Emily M Morgan
(74) *Attorney, Agent, or Firm* — Andrew S. Langsam, Esq

(57) ABSTRACT

An article of jewelry comprises a thin chain necklace surrounding the neck of the wearer. A simple mechanical closure or clasp allows the wearer to don and remove the necklace in a conventional manner. At the bottom of the front of the necklace is a pendant anchor which holds a suspended pendant and, at the same time, the pendant anchor and the pendant, minimize rotation of the necklace and its mechanical closure or clasp to remain behind the neck of the wearer. The pendant anchor is no more than the geometrical thickness of the necklace at its point of attachment and is integrally secured to the descending ends of the front of the neck segments. Preferably, the pendant anchor is in the shape of an "O," a "W," a "V," or a "U." In some embodiments the pendant anchor is provided with protrusions for further maintaining the suspended pendant on the pendant anchor. In some embodiments, the pendant anchor is welded by small "o" rings to the end links of the chain of the necklace.

13 Claims, 7 Drawing Sheets

(56) References Cited

U.S. PATENT DOCUMENTS

| | | | | |
|---|---|---|---|---|
| 6,925,838 | B1 * | 8/2005 | Carmack | A44C 7/00 63/12 |
| D706,666 | S * | 6/2014 | Zeuner | D11/7 |
| 9,364,056 | B1 * | 6/2016 | Azar | A44C 25/001 |
| 2002/0083737 | A1 * | 7/2002 | Esposito, Jr. | A44C 5/208 63/3.1 |
| 2007/0022778 | A1 * | 2/2007 | Ferlise | A44C 15/005 63/15.65 |
| 2007/0119210 | A1 * | 5/2007 | Azar | A44C 3/007 63/3 |
| 2008/0066267 | A1 * | 3/2008 | Azar | A44C 5/2076 24/303 |
| 2014/0157825 | A1 * | 6/2014 | Nadolny | A44C 15/003 63/1.11 |
| 2014/0182332 | A1 * | 7/2014 | Gray | A44C 5/20 63/3.1 |
| 2015/0216271 | A1 * | 8/2015 | Mueller | A44C 15/005 29/896.411 |
| 2015/0282574 | A1 * | 10/2015 | Edmonston | A44C 27/00 63/3 |
| 2017/0224066 | A1 * | 8/2017 | Sozio | A44C 15/001 |
| 2018/0352917 | A1 * | 12/2018 | Iguchi | A44C 11/005 |
| 2019/0133267 | A1 * | 5/2019 | De Los Santos | A44C 15/005 |

* cited by examiner

NECKLACE HAVING INTEGRATED PENDANT ANCHOR

RELATED APPLICATIONS

This application claims priority from U.S. Provisional Application No. 62/750,806, filed Oct. 25, 2018, and U.S. Provisional Application No. 62/854,976, filed May 31, 2019, the disclosures and teachings of which are incorporated herein by reference.

TECHNICAL FIELD

The present application relates to a necklace, particularly a necklace having a pendant anchor to prevent rotation of the necklace when worn. The present invention relates to a necklace with an integrated pendant anchor which serves to hold a downwardly suspended pendant, usually a gem, charm, or other jewelry item, and to reduce the tendency of the necklace to spin or rotate about the wearer's neck so as to reveal the unsightly clasping mechanism.

BACKGROUND

Necklaces have been one of the earliest forms of artistic beauty and jewelry accessories and are believed to exist since the times of the Egyptian Pharaohs and even beginning at or about the Bronze Age (~3,000 BC). Even in present times, humans, both male and female, have continued to wear artistic and fanciful chains and necklaces made of a variety of materials. They are often made of precious or semi-precious metal (often 14 or 18 kt. gold) and formed in successive links to form a length of chain. They usually are provided with a mechanical clasp for allowing the chain length to be less than the circumference of the wearer's head and still have the same fit around the neck. The mechanical clasp is generally of greater weight than the corresponding length of the chain and, thus, since the front of the chain is lower than the back of the wearer's neck, the mechanical clasp often spins or rotates about the neck and becomes exposed to view. Yet, this is considered undesirable and "takes away" from the artistic presentation of the necklace and any suspended charm or pendant. Often necklaces serve as an artistic chain mechanism encircling the wearer's neck which is for the support for a downwardly suspended fanciful charm, gem or other pendant. While beautiful to view and often works of art, there are, however, still a number of aesthetic and mechanical problems with the necklace. Necklaces often include a fastener (or clasp) that couple the ends of the necklace so that it can be placed and worn around the wearer's neck and then easily and desirably removed when no longer desired.

While being worn, the necklace oftentimes rotates around the wearer's neck such that the fastener no longer stays on the back of the wearer's neck, and may instead move towards the front of the wearer's neck thereby causing discomfort as well as making the wearer look peculiar. The sighting of the mechanical clasp often detracts from the beauty of the chain and the suspended necklace. Even though more than 5,000 years have passed since the creation of the necklace, no person has been able to completely solve this extremely important problem. Long extra lengths of chain have been suspended from the mechanical clasp to prevent the spinning/rotation of the chain (and clasp) around the neck and, yet, that adds to the cost of the chain and its weight. It also provides an extra dangling segment down the back of the neck of the wearer, often undesirable in comfort and in aesthetics.

Alternatively, a pendant or other charm or weight can be provided directly to the mechanical clasp or chain segment adjacent thereto which provides a counterweight to the front-located pendant. That, too, will reduce spinning/rotation of the chain and the mechanical clasp. However, it should be easily appreciated that adding weight or another charm to the rear of the neck of the necklace, while possibly a solution to the spinning/rotation, has other drawbacks, e.g., cost, discomfort, lack of aesthetics, etc.

The present invention is a solution to the problems of necklace wearing where the necklace might otherwise rotate or spin so as to reveal towards the front of the wearer the mechanical clasp mechanism.

Other prior art relates to simple necklaces, often of chain, with V- or a horseshoe or U-shaped pendants to be secured to the front of the necklace. Generally, however, those are merely decorative and large. In addition, the use of those V- or U-shaped pendants are separate elements of the necklace, add cost and require the attachment of the same to the necklace chain. The present invention, on the other hand, is an integrated pendant anchor or support directly secured to the lower ends of the chain of the necklace and are smaller or just as small as the geometric thickness as the chain. This ensures that the U-, W-, O- or V-shape for the pendant anchor does not add large expense, if at all, to the overall necklace and the pendant anchor does not detract from the look of the necklace and its chain/pendant.

In addition, as will be explained, in one alternate embodiment of the present invention, the pendant anchor, in contrast to the prior art of oversized and separate V- or U-shaped pendants and their connections to the lower ends of the chain of a necklace, the present invention may be provided with one or more upwardly extending small bumps or protrusions. These serve to locate the pendant for the necklace at or near the middle of the pendant anchor and restrain the same from laterally moving off of the anchor (which would again allow the mechanical back-located clasp to rotate and spin.

US 2003/0126888 A1 discloses a jewelry item that includes a loop having a first and second chain segment that cooperates with respective slides to enable a wearer to adjust the size of the loop to be a double (short) or single (long) strand necklace.

SUMMARY

The present invention is a necklace with a fully integrated pendant anchor and yet it will not add length to the necklace as the chain links will be reduced for every unit of length of the pendant anchor. That V-, O, W, or U-shaped pendant anchor is at the very front of the necklace and is of a thickness about the same or no more than that of the upwardly extending chain links of the necklace. Prior art similarly-shaped (but not sized and not integrated) V-s at the base of the necklace may hold a pendant but, generally, those pendant are fixedly attached to the V or U at the base of the necklace. The necklace of the present invention and the prior art necklaces generally are provided with a clasping mechanism in the rear, where the necklace is held onto the neck of the wearer. The pendant anchor of the present invention, integrated with the necklace segments reaching from the rear of the wearer to the front, having a central lowermost segment or point, is the holding location for a pendant which can be suspended from the pendant anchor. One or more pendants can be secured to the pendant anchor and the pendant will be restrained from movement away from and off of the pendant anchor. The weight of the pendant anchor, its location, the lower point or section for securing a pendant, all contribute to a) holding a pendant on the necklace at the bottom of the necklace and b) ensuring that the clasping mechanism does not move from the rear of the neck of the wearer. In a preferred embodiment, the pendant anchor can be flat on its rear surface and decorated with jewels, gems, or colored stones on its front. In an embodiment of the invention the pendant anchor is V-shaped and the bottom of the V is the location point for the suspended pendant. In an embodiment of the invention, the upwardly extending arms of the pendant anchor are fixedly welded or otherwise secured to the first links of the upwardly extending links of the side chains. And, in an embodiment of the invention, the inside and top surface of the V-, W-, O- and/or U- of the pendant anchor is provided with a set of spaced apart bumps or protrusions which serve as side blockers to hold the pendant therebetween.

The present invention, to the inventor's knowledge, is the only pendant anchor, integrated into the necklace, where the ends are about the same thickness as the necklace chain, where the suspended pendant can be switched, as desired, for a different pendant, as desired.

BRIEF DESCRIPTION OF THE DRAWINGS

The aforementioned and other aspects, features and advantages can be more readily understood from the following detailed description with reference to the accompanying drawings wherein.

DETAILED DESCRIPTION OF THE FIGS. AND THE PREFERRED EMBODIMENT OF THE INVENTION

Figure 1:
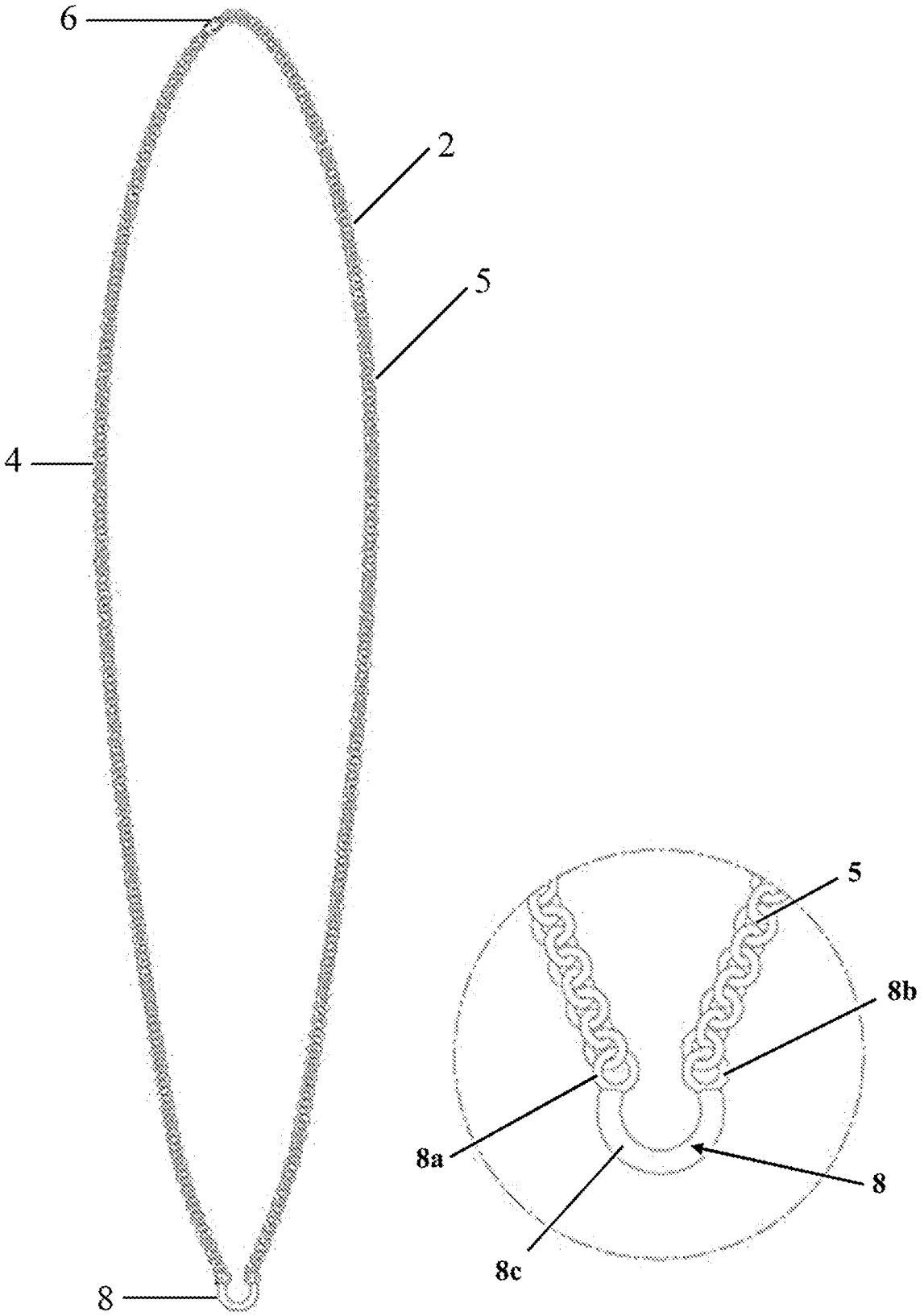
FIG. 1 shows a front view and an enlarged partial view of a necklace, with mechanical clasp at the rear, and an integrated pendant anchor of a first letter shape according to the invention.
Figure 2:
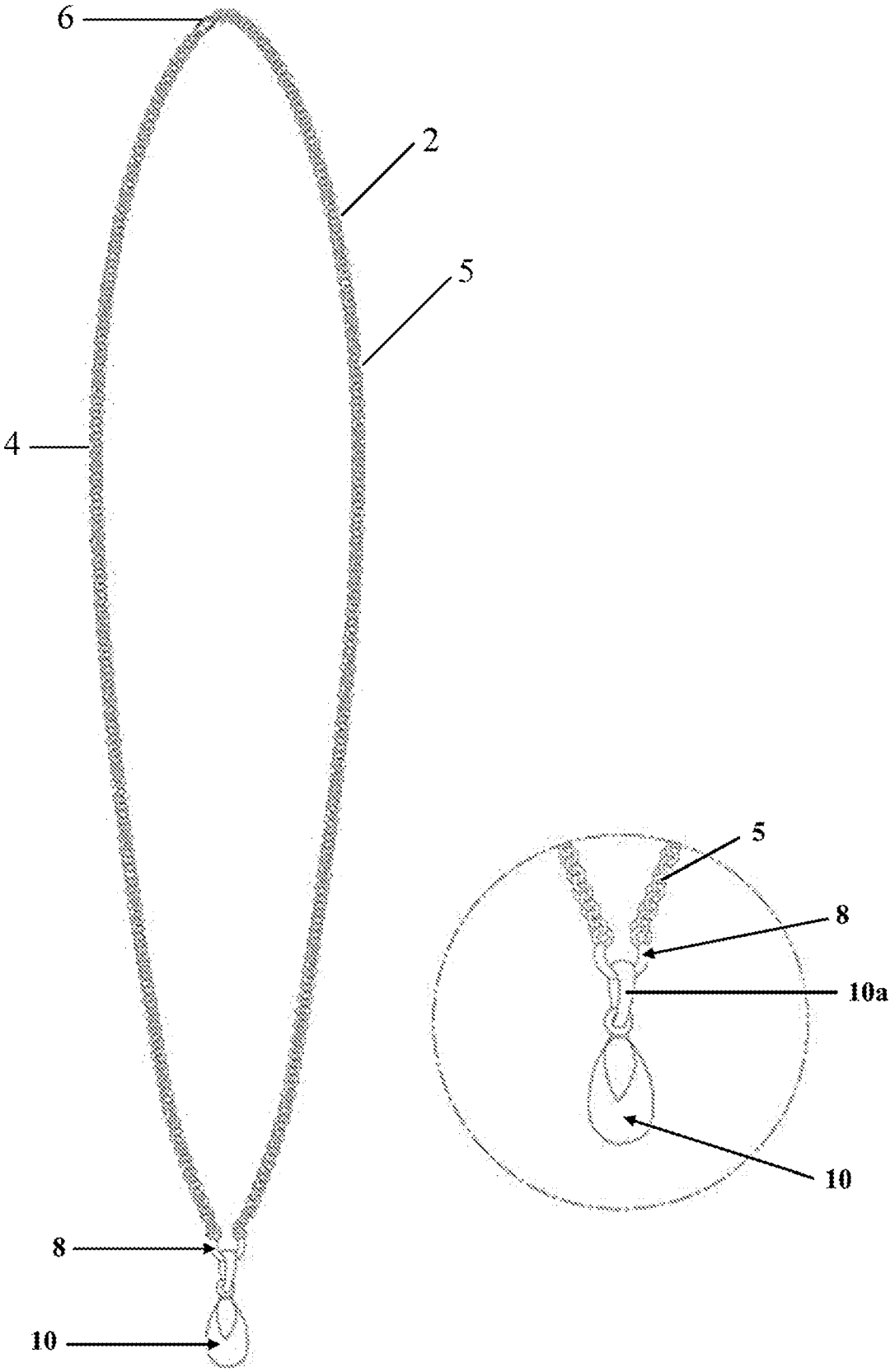
FIG. 2 shows a front view and an enlarged partial view of a necklace, with mechanical clasp at the rear, and an integrated pendant anchor of the U-shape as shown in FIG. 1 and with a suspended pendant from the pendant anchor, held by a bail, according to the invention.
Figure 3:
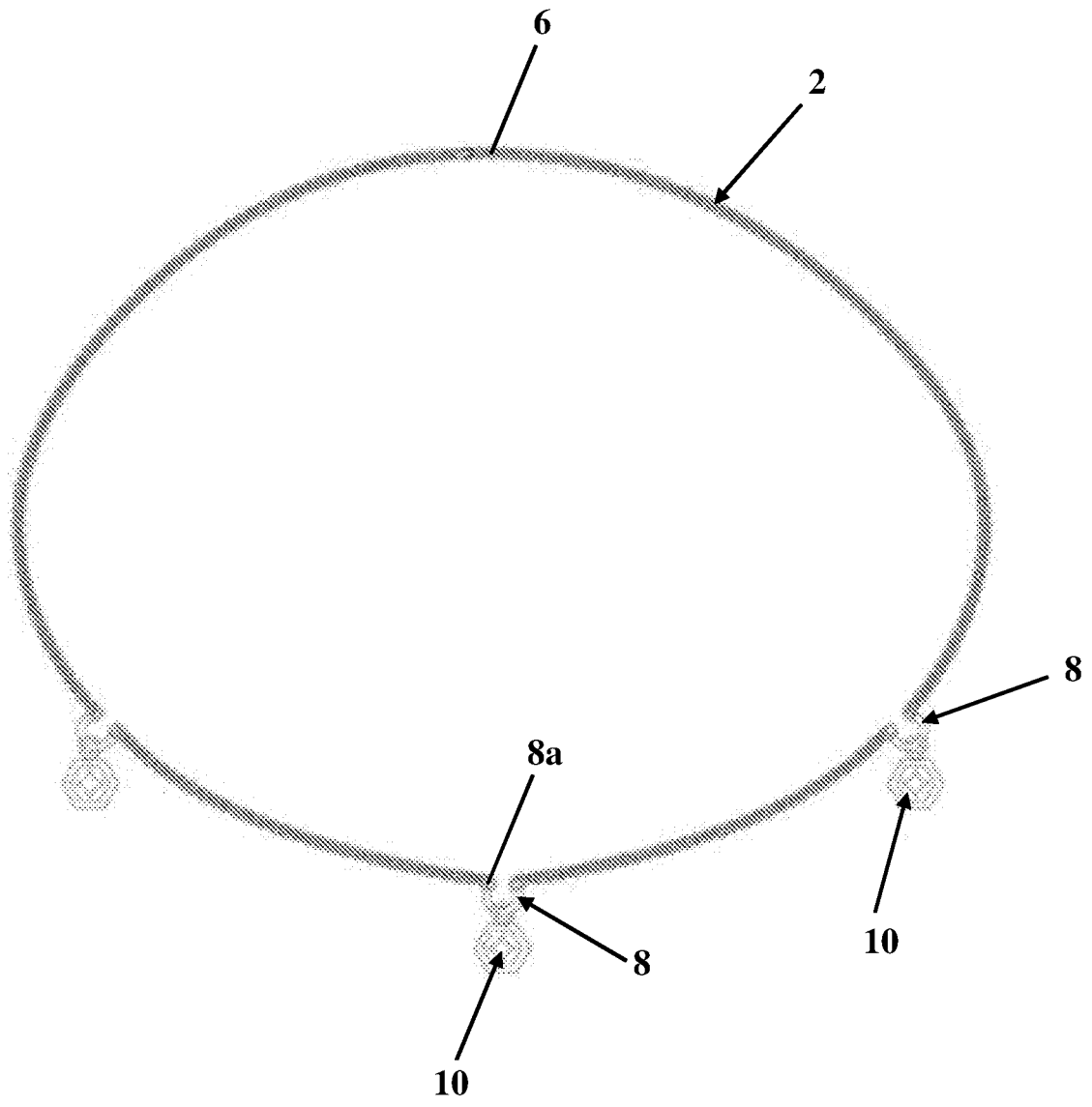
FIG. 3 shows a front view of a necklace with a small mechanical clasp in the rear, with three U-shaped and integrated pendant anchors spaced around the chain of the necklace, for supporting and suspending removable and replacable i.e., switchable decorative pendants, according to a different embodiment of a necklace with integrated pendant anchor(s) according to the invention which holds the mechanical clasp in the rear and which pendant anchor serve as securing points for one or more pendants (here, each pendant anchor is supporting a suspended pendant)

In describing preferred and alternate embodiments illustrated in the Figures of the drawings, specific terminology is employed herein for the sake of clarity. However, this disclosure is not intended to be limited to the specific terminology so selected and it is to be understood that each specific element includes all technical equivalents that operate in a similar manner. In addition, a detailed description of known functions and configurations is omitted from this specification when it may obscure the inventive aspects described herein. It should be appreciated by those skilled in the art that while various examples of necklaces with mechanical rear clasps are discussed herein, the inventive aspects of this disclosure are not limited to such examples herein.

Referring now to the Figures of the drawings, wherein like reference numerals designate identical or corresponding parts throughout the several views, FIGS. 1-4 illustrate a necklace 2 of a first embodiment of relatively closely spaced, small aperture chain links. Preferably the chain links are small and connect together in a typical jewelry chain manner, usually made of silver or gold (14 or 18 kt). Such necklace 2 includes a pair of chain link segments 4 and 5 which extend from the rear of the neck of the wearer, towards the wearer's front or throat (and beneath the neck). Each segment is made of a plurality of linked together chain links and is provided, at the rear of the neck of the wearer with a fastening member 6, a mechanical clasp generally comprising a spring loop on one side secured to one of the chain segments and on the end of the other segment is a ring for selective securement within the spring loop. These mechanical clasps are well known as are various alternatives. They serve to allow the wearer to easily and quickly secure and take off the necklace, from the neck of the wearer, without the chain link segments passing over one's head. According to the invention, a pendant anchor 8 and a pendant 10 are provided.

The pendant anchor is integrated to the other ends of the chain segments 4 and 5, i.e., opposite to the ends of the chain segments provided with the mating ends of the mechanical clasp. In the embodiment of the invention shown in FIGS. 1 and 2, as well as FIGS. 3 and 4, the pendant anchor 8 is integrated to the ends of the chain segments by a pair of small loops passing though the lowermost rings or links of the opposed segments 4 and 5. Alternatively, the sides of the pendant anchor are not provided with those side apertures but rather the pendant anchor is spot welded to the lowermost edge of the chain links. Here, the welding of the pendant anchor directly to the outside edge of the lowermost chain link will allow the entire chain to appear as a single thickness of material, to the designer and wearer's benefit. The integration of the pendant anchor is believed important to the commercial success of the necklace as to require a jeweler to attach a pendant anchor as disclosed would be time consuming and expensive. The continuous necklace 2 or band formed by the two segments of chain 4 and 5 and the pendant anchor 8 may be of any material and generally forms an article of jewelry having a closed-loop arrangement that can be worn by a person around his or her neck. For example, the necklace 2 may be a chain, cord, string, rope, twine, cable, wire, tape, lanyard, etc, each of which may comprise material including, but not limited to, silver, gold, platinum, stainless steel, titanium, copper, alloy, fabric, leather, string, rope, and wire. In the present and preferred embodiment, the necklace 2 comprises 14 kt or 18 kt gold or is made of sterling silver links. A first necklace 2 is comprised of chain link segments 4 and 5. In an exemplary embodiment, the first segment 4 and the second segment 5 are the same length as each other. While the mating ends of the mechanical clasp 6 are secured to the rear ends of the chain segments 4 and 5, in usually manner, the ends of the pendant anchor 8 (FIGS. 1 and 2, for example, showing a U-shaped pendant anchor 8) has aperture ends 8*a* and 8*b* which secure to the downward-most ends of the chain link segments 4 and 5. As can be seen in the representative Figures, the size of the aperture ends or loops 8*a* and 8*b*, which connect to the lowermost links of the segments 4 and 5 are about the same or preferably only slightly smaller or larger than the geometric thickness or circumference of the lengths of chain segments 4 and 5. And, the cross section of the pendant anchor 8, especially at its rounded or lowermost end 8*c*, is also less than or about the same as the geometric thickness (or cross section) of the chain link segments 4 and 5. This can be seen in the inset enlargement of FIG. 1. In an exemplary embodiment, the width of the cross section of the rounded end 8*c* and the chain link segments 4 and 5 may go up to 15 mm (preferably between 1 mm and 5 mm or between <(less than) 1 mm and 5 mm). As a result, the pendant anchor 8 appears as a continuation of the chain link segments 4 and 5. Due to this configuration, the wearer of the necklace has an easier time in selecting a pendant that can match the fashion style of the chain link segments 4 and 5. Thus, it is not necessary for the wearer to take time in ensuring that the pendant matches the fashion style of both the pendant anchor 8 and the chain link segments 4 and 5. In other words, if thickness is measured from the back chain segment to the visual front of the chain, then the pendant anchor will have the same dimension in thickness.

As a result of the two chain link segments 4 and 5, the mechanical clasp 6, the ends 8*a* and 8*b* secured to the lowermost ends of the chain link segments 4 and 5, with the pendant anchor 8 therebetweeen, a closed-loop necklace 2 is provided. Such closed-loop may, for example, be in the shape of an oval, circle, ellipse, etc. A decorative pendant 10 can be secured to the pendant anchor 8 between the ends 8*a* and 8*b* by securement means 10*a*, which includes a bail, spring ring or other mechanism. In the preferred embodiment, the diameter of the loop and securing ends 8*a* and 8*b* of the pendant anchor 8 are large enough to at least restrain if not block the movement of the pendant above the ends and onto the chain link segments 4 and 5.

The fastening or mechanical clasping member 6 may be a conventional mechanical clasp or spring ring or other fastener (magnetic, screw with threads and receiving threads, even hook and loop fastener) that is used to couple, connect and/or hold the back end of the first segment 4 to the back end of the second segment 5, behind the wearer's neck. For example, the fastening member 6 may comprise magnetic components that allow the fastening member 6 to be attached via a magnetic field. In another example, the fastening member 6 may comprise snap-together components. Further, the fastening member 6 may have components attached to one or both ends of a chain (depending on the type of clasp or fastener used) for keeping the two ends of a chain together. As such, the back end of the first segment 4 may be capable of separating from the back end of the second segment 5 via the fastening member 6 so as to create an open-loop. Such arrangement may assist a person in wearing the necklace 2 and in taking the same off. For example, the closed-loop of the necklace 2 may have a diameter that is smaller than the wearer's head (i.e. the head of the person may not be able to go through the closed-loop of the necklace). As such, by separating the back ends of the segments 4 and 5, one can close and secure the necklace 2 around the neck of the person, and reattaching the back ends of the segments 4 and 5 via the mechanical clasp or fastening member 6, the person is able to wear the necklace 2. In an exemplary embodiment, the mechanical clasp or fastening member 6 is disposed on the back of the person's neck when worn. The fastening member 6 can be made of precious or semi-precious material including, but not limited to, silver, gold, platinum, or other materials, e.g., copper, titanium, stainless steel, alloy, plastic, etc.

The pendant anchor 8 may be made of material including, but not limited to, gold, silver, platinum, stainless steel, titanium, copper, alloy, plastic, silicon, and melamine. In an exemplary and a preferred embodiment, the pendant anchor 8 is formed and made of gold and integral with the lower and front ends of the segments 4 and 5 by connecting the rings, apertures or ends 8*a* and 8*b* of the pendant anchor 8 to the free and lowermost end links of the chain segments 4 and 5. In an exemplary embodiment, the pendant anchor 8 has a geometric width or thickness which is substantially the same or slightly less or only slightly more than the width or overall thickness of the necklace 2 formed of the chain links such that the pendant anchor 8 appears to be a mere suspending lower tip of the necklace 2, as seen by a viewer from a short distance. In yet another exemplary embodiment, the pendant anchor 8 may be similar in thickness to the chain links forming the necklace 2 so that the pendant anchor 8 visually blends with the segments 4 and 5 such that the pendant anchor 8 appears to be a visual continuation of the chain.

In addition, the pendant anchor 8 may include decoration on its surface such as, but not limited to, a set of jewels, gems, stones, an engraved design or pattern engravings, precious stones, semi-precious stones, beads, glass, or other suitable decorative objects that are attached to the front of the pendant anchor 8. Preferably, the rear surface of the pendant anchor is smooth (as it sits on the skin/neck of the wearer) and more preferably, the rear surface is substantially flat. Moreover, the pendant anchor 8 may be used with bracelets, utility necklaces, or other chains that have require objects on a chain to be held in place and which serves to restrain spinning or rotation of the necklace about the wearer's neck. While the pendant anchor 8 can be any shape or size, such as, but not limited to, a "V," "U," "W," a partially open "O," or any other suitable shape (letter or otherwise) that can achieve the same purpose, the pendant anchor 8 preferably is one of those letter shapes and may be configured to include steep, perpendicular, or angled inward or even outward side legs to naturally cause the suspended pendant 10 to fall by gravity back into the center of the pendant anchor 8 as the person moves about with the worn necklace.

In some embodiments the chain links of the side segments are interlocked with the apertures or rings at the ends of the pendant anchor. In other embodiments, the ends of the pendant anchor are welded or directly linked to the outside and bottom edges of the lowermost link of the chain links.

In the embodiment wherein apertures or rings are provided for securing the pendant anchor to the side chains, their size and location help to maintain the suspended pendant from moving off of the pendant anchor. Rather, in this embodiment with apertures or rings for holding the pendant anchor to the side segments, their mere presence reduces the gap between the opposing ends of the pendant anchor to act like a barrier.

In an embodiment, the pendant anchor 8 comprises a gently curved lower member 8*c* (See FIG. 1, enlarged inset) forming a U-shape with the bightss or legs of the pendant anchor extending upwardly or a partially open "0" shape) that comprises a first end 8*a* that becomes one pendant anchor ring and a second end 8*b*, on the other side of the pendant anchor 8, extending from the curved lower member 8*c* that is connected to the other free end of a lowermost chain link of the chain link segment 5. The pendant anchor ring 8*a* is connected to the lowermost, second or free end of the first chain link segment 4 while the pendant anchor ring 8*b* is connected to the lowermost, second or free end of the second chain link segment 5. In an exemplary embodiment, in which the necklace 2 is a chain comprised of small links linked together, the pendant anchor rings 8*a*, 8*b* form a part of the length of the necklace. The rings 8*a* and 8*b* of the pendant anchor 8 can be identical in geometry and thickness to that of the lowermost of the chain links forming the segments 4 and 5.

Soldering is performed for the purpose of permanently joining (i.e. bonding) at least two objects via a filler material that has a lower melting point then the adjoining two objects. Solder filler material may be composed of many different alloys. For example, solder filler material may include, but is not limited to, antimony (Sb), bismuth (Bi), copper (Cu), nickel (Ni), Cobalt (Co), Indium (In), lead (Pb), tin (Sn), silver (Ag), zinc (Zn), germanium (Ge) and/or phosphorous (P). In an example of a soldering process in the present invention and the preferred embodiments, the lowermost, second or free end of the first segment 4 is placed directly adjacent to the pendant anchor ring 8*a* such that the second end of the first segment 4 and the pendant anchor ring 8*a* are secured to one another. These two components are preferably connected so that the pendant anchor is integral with the chain link segment. Alternatively, the pendant anchor is devoid of apertures or rings and, in this case, the pendant anchor is welded or soldered to the end links of the opposing chain links of the side segments. The manner of holding the pendant anchor to the segment 4 is the same as that used for holding the other, lowermost, second and free-end of the pendant anchor 8 to the other chain link segment 5. In any event, the necklace is formed with chain links 4 and 5 and an integrated pendant anchor 8 at the bottom ends of the chain links with a mechanical closure 6 located towards the rear and back of the necklace 2.

The pendant 10 is then, fixedly or selectively removably and another pendant placed, secured to the pendant anchor 8 via a bail, jump ring, or similar securing device. For example, in the present embodiment, the pendant 10 may include a pendant ring 10*a* that is secured over the curved segment 8*c* of the pendant anchor 8 by having the smooth wall portion of the pendant anchor 8 pass through the hollow loop or bail mechanism of the pendant holding device or ring 10*a* of the pendant 10. As a result of such arrangement, the pendant 10 loosely hangs down from the pendant anchor 8 such that the pendant 10 can swing side to side and, yet, significantly without separating from the pendant anchor 8 and surely not easily being able to climb up the chain link segments 4 or 5. This prevents the spinning or rotation of the necklace and the viewing of the mechanical clasp 6 in the rear from coming into view around the front on the wearer. In an exemplary embodiment, there may be multiple pendants 10 on the necklace 2—a consequence of multiple pendants suspended from a single pendant anchor 8 or as a consequence of multiple pendant anchors 8, preferable spaced apart, on the chain link segments 4 and 5 (see FIGS. 3 and 4). In the example of the pendant anchor 181*c* shown as the third embodiment down in FIG. 7, two pendants 10 can be suspended from the W-shaped pendant anchor with each pendant 10 held in one side of the W shape as a bump or protrusion 186 separates the pendants 10.

The pendant anchor rings 8*a*, 8*b* may be shaped and/or formed in a manner to impede the pendant ring or bail device

10*a* (and, by extension, the pendant 10) from moving onto the first or second segments 4 and 5 while the pendant 10 may still move and bounce a bit due to normal wear conditions (i.e. while the wearer is walking). However, the pendant anchor rings 8*a*, 8*b* may still be capable of passing through the hollow loop 10*a* of the pendant 10. But, as a consequence of gravity, the pendant will tend to stay in the middle of the pendant anchor 8, will stay in the middle of the necklace 2, and thus the mechanical closure will tend to stay in its place in the back of the wearer's neck.

Once the pendant 10 is secured to the pendant anchor 8, the pendant 10 creates a counterweight which retards and even prevents the necklace 2 from rotating thereby maintaining the mechanical closure or fastening member 6 on the back of the wearer's neck. In other words, the shape and location of the integrated into the necklace pendant anchor 8 impedes the pendant 10 from moving onto the segments 4 and 5 thereby maintaining the pendant 10 in the middle and on the pendant anchor 8. Such impeding results from integration of the pendant anchor 8 to the chain link segments 4 and 5, the combination of the pendant anchor rings 8*a*, 8*b* (or directly welding or soldering the pendant anchor to the bottom most of the chain links) and the partially open V, U, W, or O-shaped structure of the pendant anchor 8 (which causes the securement means 10*a* to slide towards the bottom and middle of the pendant anchor 8). In turn, the weight of the pendant 10 prevents spinning or rotation of the necklace 2 about the wearer's neck, thereby maintaining the necklace 2 in a position in which the mechanical clasp or fastening member 6 is disposed on the back of the wearer's neck.

Figure 4:
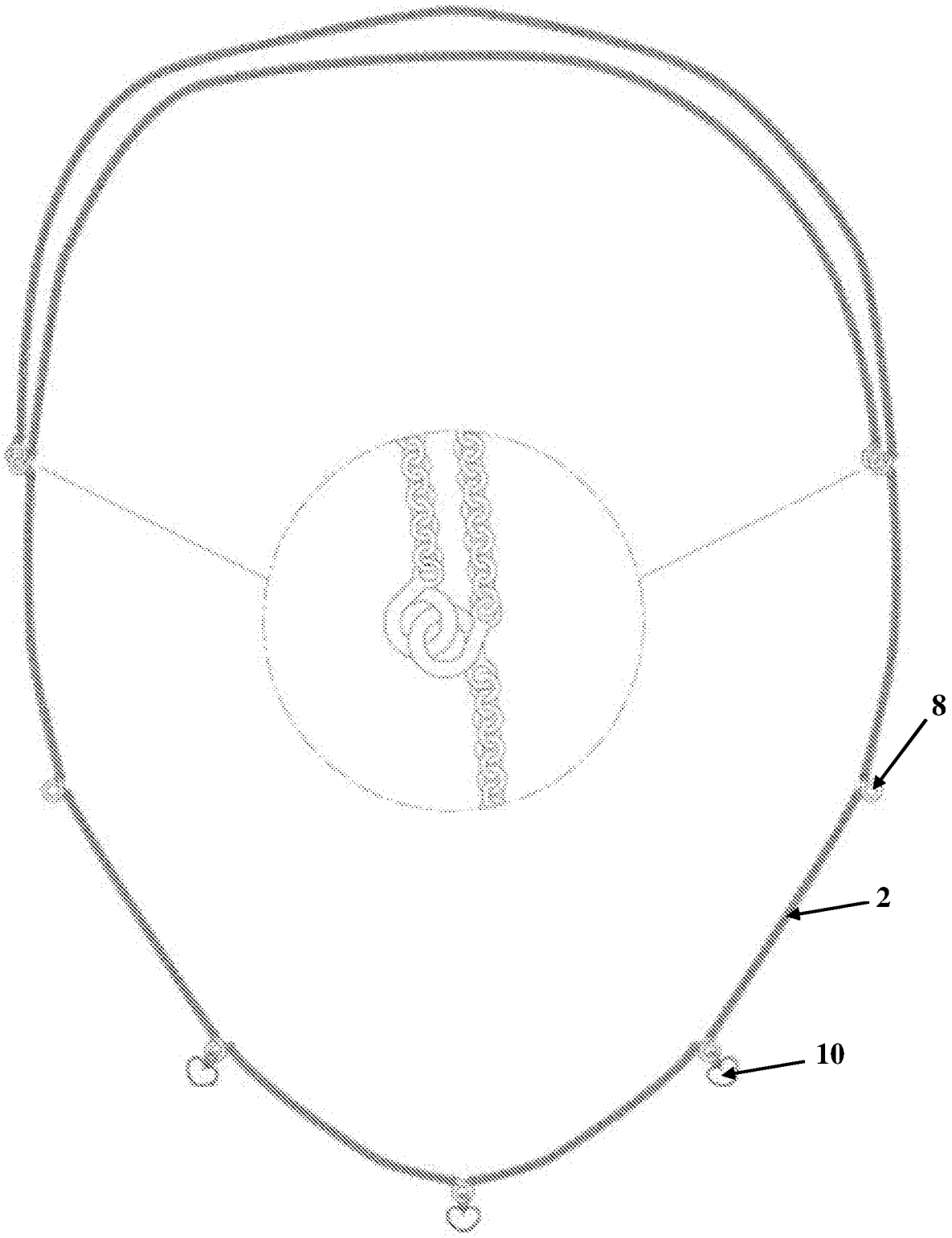
FIG. 4 shows a front view of a necklace having one or more mechanical clasp like devices at the rear and sides which also serve to lengthen or shorten the necklace and multiple O-shaped (they loop over themselves) pendant anchors or pendant anchors without apertures, three of which are shown with suspended, decorative pendants, as an alternative version of invention; The mechanical clasps at the sides are sold as apertures or loops, too, but it should be appreciated that these could be mechanical clasps with spring release openings.

FIG. 4 shows an embodiment of the necklace 2 where the length is adjustable by having two end rings which can slide and clasp one another actually connected to intermediate rings in the chain link segments 4 and 5 (as seen in the enlarged inset) or one part of the mechanical clasp 6 can secure to a loop in the chain link segment with the other mechanical clasping mechanism securing to another loop in the other chain link segment. This allows for a shorter or longer necklace, depending upon where the mechanical clasping devices are secured, either to one another or to intermediate loops in the chain link segments 4 and 5. The use of the pendant anchor will not necessarily extend the length of the desired necklace as the length of chain links can be modified to accommodate the insertion and length of the pendant anchor.

Figure 5:
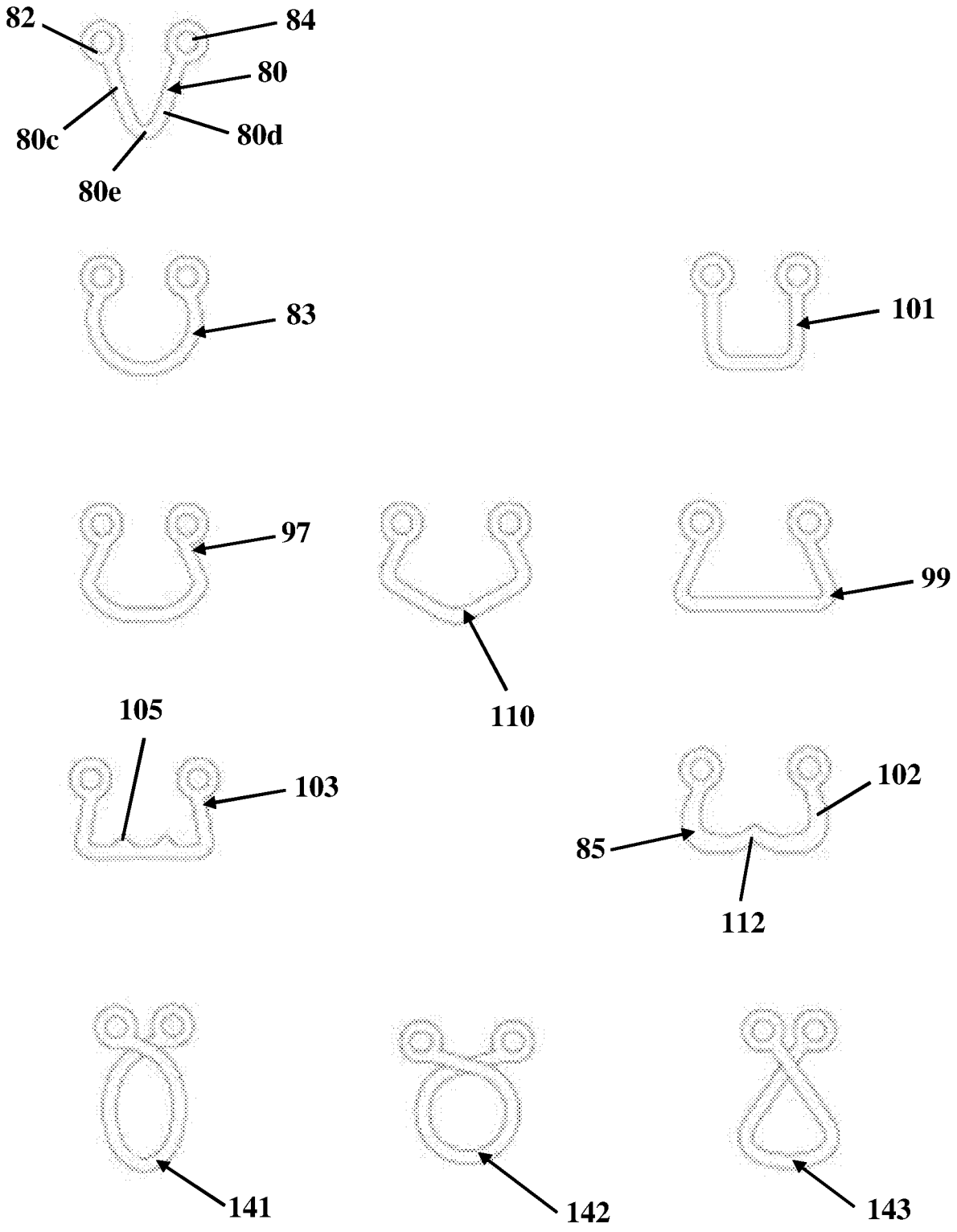
FIG. 5 shows a front view of a variety of pendant anchors which can be integrated to the chain of a necklace, the necklace then extending around the wearer's neck, meeting in a mechanical clasp, with the pendant anchor having a central location for suspending one or more pendants therefrom. The openings at the top of the pendant anchors are apertures which can receive and be secured to the first chain link on each side of the necklace. Alternatively, the chain with ring links is welded onto a pendant anchor without those more visible side apertures and when the welding connection is provided the viewer will see mostly the side chain links continuing to the lowermost point of the pendant anchor. Stated differently, the pendant anchor which is directed welded to the side chain link segments is visually indistinguishable from the ring links. So, for aesthetic importance the welding of the pendant anchor may be preferred. And, it eliminates the possibly unsightly side apertures of the pendant anchor where the same connects to the lowermost portion of the chain links. Of course, no apertures may be present and other mechanisms can be provided for integrating/securing the pendant anchor to the necklace. Notice, too, that a set of bumps or upwardly extending protrusions are provided to the bottom of the W-shaped pendant anchor for locating a pendant therebetween. Some of the anchor pendants in this FIG. are loops and, yet, a pendant can be placed onto the pendant anchor for securement therewith. The apertures, while slightly greater than or the same thickness of the chain to which the same are attached, serve as another mechanism for securing the pendant in the center, front of the necklace, to reduce the spinning or rotation of the necklace about the wearer's neck.
Figure 6:
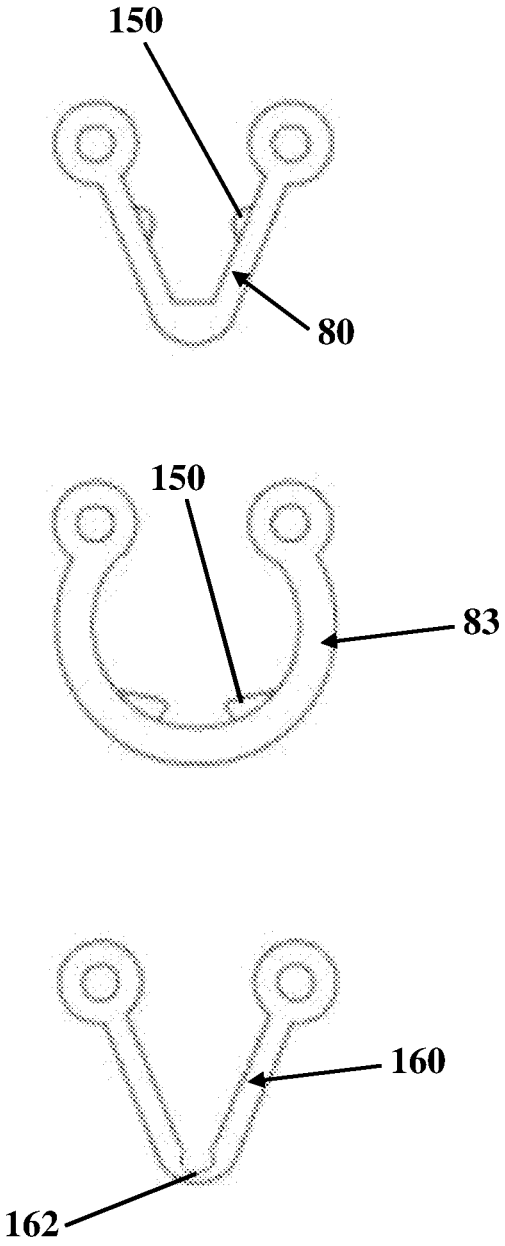
FIG. 6 shows front views of three pendant anchors, a V-shape, an open O- with circular and not straight sides and/or also known as a U-shape and another V-shape with the first two showing bumps or protrusions for holding the pendant in place and the bottom shown V-shape having a further cut-out at the lowermost point, so as to eliminate the need for protrusions or bumps and, yet, the pendant is maintained in the middle of the pendant anchor as its bail or loop for supporting the same on the necklace will fit within and be suspended from that cut-out area. As in some of the other embodiments, the pendant anchors shown here are provided with apertures for holding the same to the chain ends of a necklace so that the pendant anchor is integrated therewith and, in addition, those relatively enlarged openings or apertures serve to retain the pendant and its mechanism for holding the same to a necklace in the middle. Here, too, in the preferred embodiment, the apertures are quite small and their outside circumference or diameter is not much bigger or about the same thickness as that of the chain.
Figure 7:
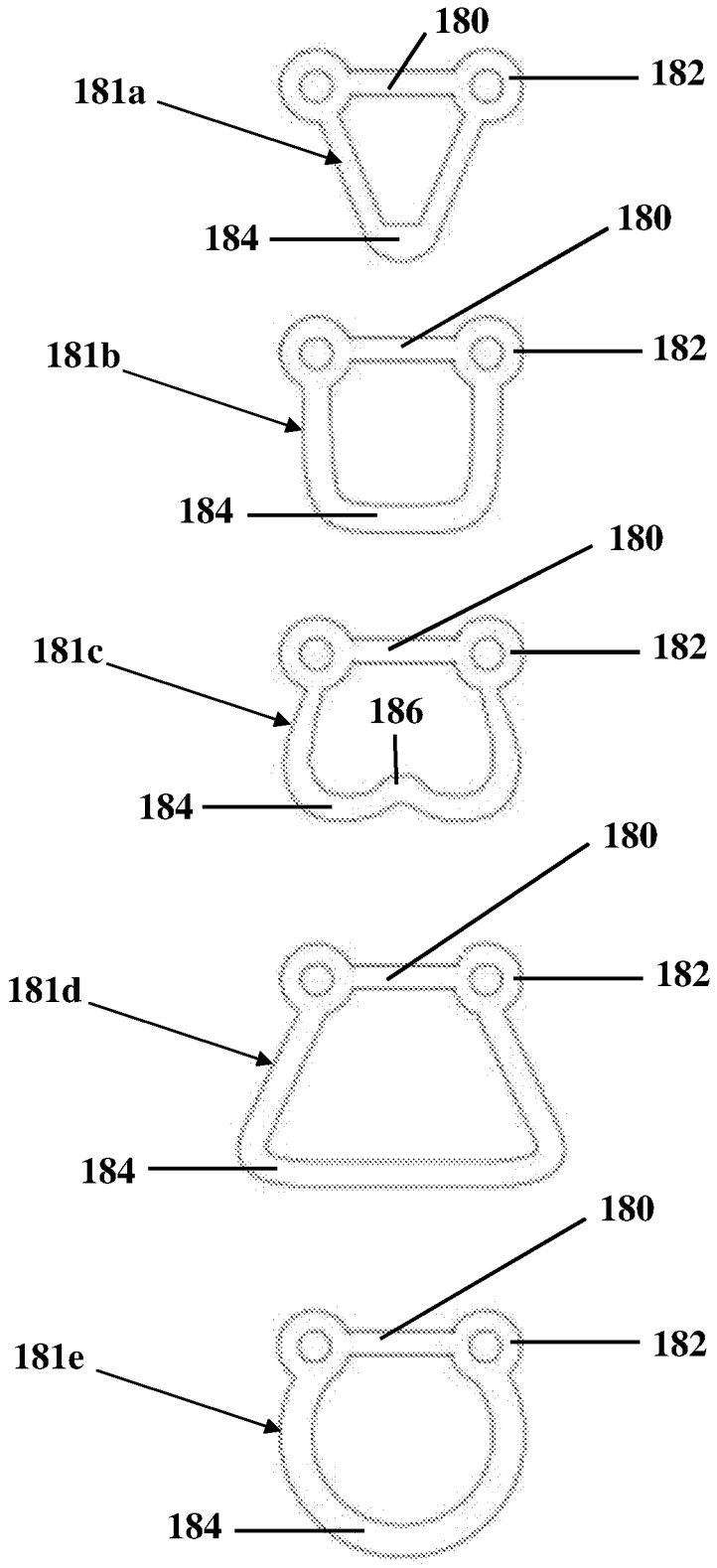
FIG. 7 are alternative embodiments of the pendant anchors for the integration to a necklace of preferably thin chain but, in these, the pendant anchor is a closed loop of material with openings or apertures (or directly welded to the chain) for integrally securing the same to the ends of the chain of the necklace and the pendant being capable of being suspended from the bottom of the pendant anchor element. Here, a suspended pendant could be hung from the pendant anchor by a bail or loop of material which extends over and clasps onto the bottom of the pendant anchor. One embodiment, the third, shows a pendant anchor in the W-shape and this allows for two or more pendants to be separately suspended by the necklace. Upwardly extending bumps or protrusions could be provided to the bottom segment of these pendant anchors, if desired, to maintain the pendant(s) in a precise location.

FIGS. 5-7 illustrate various embodiments of the pendant anchor 8. In one embodiment the newly shown pendant anchor 80 is substantially V-shaped. In other words, the pendant anchor 80 includes a first elongated portion 80*c*, a second elongated portion 80*d*, and a central portion 80*e*. A first open end 82 of the first elongated portion 80*c* is connected to the lowermost link of the chain link segment 4. The open end 84 of the second elongated portion 80*d* is connected to the lowermost link of the other chain link segment 5. This V-shaped arrangement creates a sharp inside or acute angle in which the space between the first elongated portion 80*c* and the second elongated portion 80*d* increases going upwardly from the central portion 80*e*.

In the just described embodiment, the pendant 10 is suspended from the V-shaped pendant anchor 80 via a jump ring or bail that is secured to the pendant. The pendant will hang on the central portion 80*e*. This pendant anchor is also meant to be integrated to the necklace, as described above, and the thickness of the first and second elongated portions are small and about the same as the thickness of the chain link segments 4 and 5 to which it is attached. And, the distance between open end 82 and open end 84 is small, enough to allow a bail or ring of the pendant 10 to suspend therefrom but extending a small distance so as not to detract from the continuity of look of the chain links.

FIG. 5 illustrates alternative embodiments of the pendant anchor in shapes, including the V- (80), U- (83), W-(right column, 85), widened U- (97), straight and widened U (99), straight U (101), double W- (103)—with two bumps 105), and combined U- and V (110). As can be seen, two embodiments 103 and 85 depict the upwardly extending bumps or protrusions 105. These bumps or protrusions which extend upwardly from the bottom of the pendant anchors serve to retain the pendants on the lower portion of the pendant anchor and separate the pendants from one another, if more than one pendant and bail of a pendant are provided.

FIG. 5 also shows cross over pendant anchors 141, 142, 143 which are referred to as an oval shape, a circular or O shape and a triangle shape for the pendant anchor to be integrated into a necklace 2 for holding the bail or ring of a pendant. Each is provided with rings for securement to the lowermost chain links of the segments 4 and 5 to form a necklace 2, just as the pendant anchor 8. These cross over pendant anchors are still small and of about the same, a bit more or less than the thickness of the segments 4 and 5 to which the pendant anchors are attached. Again, however, the pendant anchor of the present invention may have no apertures or rings and, in this embodiment, the sides of the pendant anchor are directly soldered or welded to the outside edge of the lowermost chain links of the side segments.

FIG. 6 shows the pendant anchors of the V-shape, the U-shape and a cut-out U-shape with the V-shape and the U-shape substantially the same as shown in FIG. 5 except bumps or protrusions 150 are provided along the opposed legs or bights of the pendant anchors. Again, these bumps or protrusions 150 serve to maintain the bail or loop of the pendant 10 in place, on the pendant anchor, which tends to minimize and eliminate, possibly, the spinning of the necklace about the wearer's neck. The embodiment shown in FIG. 6 referred to as the cut-out V-shape 160 is provided with a recess 162 which will secure a ring or small bail of a pendant 10 to hold the same in a precise middle location.

FIG. 7 shows other embodiments of the pendant anchor 8 (e.g., pendant anchors 181*a*-181*e*) with the rings/apertures for securement to the lowermost links of the chain link segments 4 and 5 and showing the lower segments of the pendant anchors being basically horizontal for supporting a bail or ring of a pendant. These embodiments are closed and can be integrated to the necklace 2, at original manufacture, but then the pendant needs to have its bail or ring slid over a side leg of the pendant anchor for the pendant cannot get to the middle of the pendant anchor by sliding down the chain. These embodiments tend to maintain the pendant even more securely in the middle of the lowermost portion of the necklace In these displayed embodiments the top leg or connection of the pendant anchor are horizontal bars 180 extending between the apertures 182 which are connected to the lowermost chain link of the segments 4 and 5 forming the necklace 2. Of course, a pendant 10 is secured to these pendant anchors supported on lowermost surface or leg 184. One embodiment (third down) displays a W-shape for the pendant anchor and it can thus support a pair of pendants 10. A small bump 186 is provided to maintain each of the two pendants separated from one another and in place.

The aforementioned specific embodiments are illustrative, and many variations can be introduced on these embodiments without departing from the spirit of the disclosure or from the scope of the appended claims. In addition, elements and/or features of different examples, and illustrative embodiments may be combined with each other and/or substituted for each other within the scope of this disclosure and appended claims.

What I claim is:

1. An article of jewelry comprising:

a) a chain necklace having a rear segment formed from two sections continuously extending into a front segment, said rear segment having a fastening member for selectively securing said article of jewelry around the neck of a wearer, said fastening member composed of at least one component disposed on at least one section of the rear segment;

b) a pendant anchor integrally secured to and between the ends of center sections of said front segment, said pendant anchor being of about the same or less than the geometrical thickness as said center sections of said front segment, and said pendant anchor has the basic shape of a letter selected from the group comprising: a "U", a "V", and a "W" which forms two opposed ends, one each secured to said ends of said center section of said front segment and further comprising a downwardly extending pendant-holding segment for holding and locating a pendant on said pendant anchor between said ends of said pendant section anchor and said ends of said center section of said front segment, said pendant anchor is further provided with one or more upwardly extending bump-like protrusions between said ends of said pendant anchor for further holding and locating a pendant therebetween; and c) a pendant with a securement means for allowing said pendant to be secured to and removed from said pendant anchor, wherein said pendant anchor and said pendant are configured to prevent rotation of the chain necklace about the neck of a wearer and maintain the chain necklace in a position in which said fastening member is disposed on the back of the neck of a wearer, and wherein each end of the pendant anchor has an aperture formed in the body of said pendant anchor at said end for connecting said pendant anchor to said center sections of said front segment, said aperture having a continuous unbroken perimeter.

2. An article of jewelry as claimed in claim 1, wherein at least one of said front segments is provided with one or more additional pendant anchors.

3. An article of jewelry as claimed in claim 1, wherein said pendant anchor has a geometrical thickness of about 1-5 mm.

4. An article of jewelry as claimed in claim 1, wherein said chain necklace is made of a precious or semi-precious metal or alloy of metal.

5. An article of jewelry as claimed in claim 4, wherein said metal is 18 or 14 karat gold.

6. An article of jewelry as claimed in claim 1, wherein said pendant anchor has a substantially rear flat surface.

7. An article of jewelry as claimed in claim 6, wherein the front side of said pendant anchor is decorated with precious or semi-precious jewels.

8. An article of jewelry as claimed in claim 1, wherein said pendant's securement means is a bail, jump ring or clasp which mechanically passes over said opposed ends of said center section.

9. An article of jewelry as claimed in claim 1, wherein said pendant anchor is securely welded to the opposed outside ends of said center section of said front segments.

10. An article of as claimed in claim 1, wherein said pendant anchor defines a lowermost area and said lowermost area is surrounded on both sides by a pair of opposed protrusions.

11. An article of jewelry as claimed in claim 1, wherein said pendant anchor has the visual appearance of said chain link segment.

12. An article of jewelry comprising:

a) a chain necklace having a rear segment formed from two sections continuously extending into a front segment, said rear segment having a fastening member for selectively securing said article of jewelry around the neck of a wearer, said fastening member composed of at least one component disposed on at least one section of the rear segment;

b) a pendant anchor integrally secured to and between the ends of center sections of said front segment, said pendant anchor being of about the same or less than the geometrical thickness as said center sections of said front segment, said pendant anchor has the basic shape of a letter selected from the group comprising: a "U", a "V", and a "W" which forms two opposed ends, one each secured to said ends of said center section of said front segment and further comprising a downwardly extending pendant-holding segment for holding and locating a pendant on said pendant anchor between said ends of said pendant anchor and said ends of said center section of said front segment, said pendant anchor is further provided with one or more upwardly extending bump-like protrusions between said ends of said pendant anchor for further holding and locating a pendant therebetween; and c) a suspended pendant, said pendant and said pendant anchor have a weight greater than the weight of said fastening member for selectively securing said article of jewelry around the neck of a wearer, wherein said pendant anchor and said pendant are configured to prevent rotation of the chain necklace about the neck of a wearer and maintain the chain necklace in a position in which said fastening member is disposed on the back of the neck of a wearer, and wherein each end of the pendant anchor has an aperture formed in the body of said pendant anchor at said end for connecting said pendant anchor to said center sections of said front segment, said aperture having a continuous unbroken perimeter.

13. A jewelry necklace for arrangement on a neck of a wearer, comprising:

a chain comprised of two chain link segments configured to extend behind the neck of the wearer and towards the front of the neck of the wearer, said chain link segments configured to be secured to one another with a conventional jewelry clasping mechanism behind the neck of the wearer;

said two segments being secured to one another at the front of the neck of a wearer by a pendant anchoring device, said pendant anchoring device comprising:

i) a thickness of the same or less than a thickness of said chain link segments;

ii) an integrated aperture of solid thickness at each of the distal ends of said pendant anchoring device and connecting each end of said pendant anchoring device directly to a segment of said chain link segments of said chain at the front of the neck of the wearer, said integrated aperture having an unbroken perimeter;

iii) said pendant anchor has the basic shape of a letter selected from the group comprising: a "U", a "V", and a "W" which forms two opposed ends;

iv) said pendant anchor is further provided with one or more upwardly extending bump-like protrusions between said ends of said pendant anchor for further holding and locating a pendant therebetween;

said pendant anchoring device further comprising a downwardly extending and suspended central segment for suspending and locating a removable pendant therefrom, such that said pendant and said pendant anchoring device tend to eliminate spinning rotation of said jewelry clasping mechanism around the neck and towards the front of the wearer.

* * * * *